United States Patent [19]

Mayer

[11] 4,402,615

[45] Sep. 6, 1983

[54] MIXING TUBE FOR DRYING BUILDING MATERIALS

[75] Inventor: Karl M. Mayer, Immenhofen, Fed. Rep. of Germany

[73] Assignee: Wachter KG Hindeland, Fed. Rep. of Germany

[21] Appl. No.: 182,574

[22] Filed: Aug. 29, 1980

[30] Foreign Application Priority Data

Aug. 30, 1979 [DE] Fed. Rep. of Germany ..... 2935007

[51] Int. Cl.[3] ..... B28C 5/08; B01F 7/26

[52] U.S. Cl. ..... 366/65; 366/102; 366/195; 366/302; 366/312

[58] Field of Search ..... 366/65, 66, 67, 64, 366/51, 50, 190, 195, 196, 302, 303, 304, 305, 306, 307, 309, 312, 313, 101, 102

[56] References Cited

U.S. PATENT DOCUMENTS

| | | | |
|---|---|---|---|
| 1,102,696 | 7/1914 | Shiner | 366/303 |
| 2,204,029 | 6/1940 | Russell | 366/305 |
| 2,513,012 | 6/1950 | Dugas | 366/51 |
| 3,940,115 | 2/1976 | Zipperer | 366/303 |
| 3,986,706 | 10/1976 | Giombini | 366/303 |
| 4,225,247 | 9/1980 | Hodson | 366/65 |

*Primary Examiner*—Robert W. Jenkins

*Attorney, Agent, or Firm*—Burton, Parker & Schramm

[57] ABSTRACT

This case is drawn towards an apparatus which mixes dry building materials. The building materials are mixed with air and water in a continuously flowing manner. The apparatus has a mixing tube with a rotating shaft. The materials are fed into the tube in its upward portion, moves downward passing a series of supporting plates which are attached to the sides of the tube in the conical shaft alternatively in a conically sloping manner.

14 Claims, 4 Drawing Figures

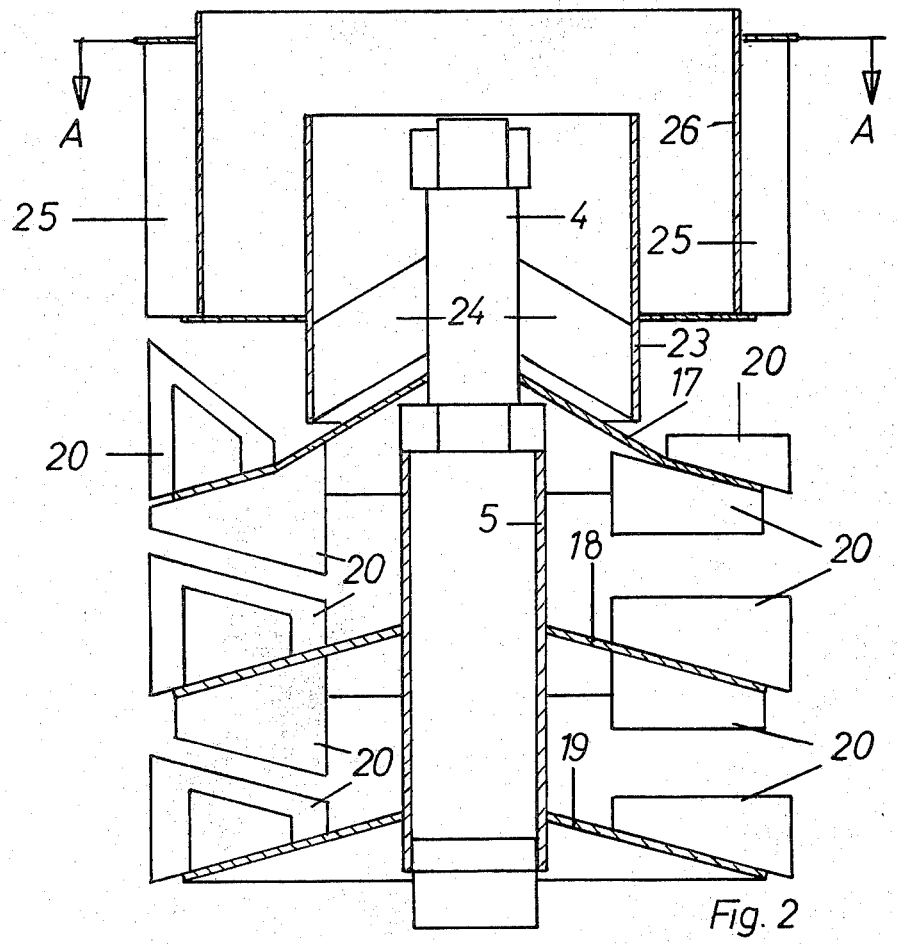
Fig. 2
Fig. 3
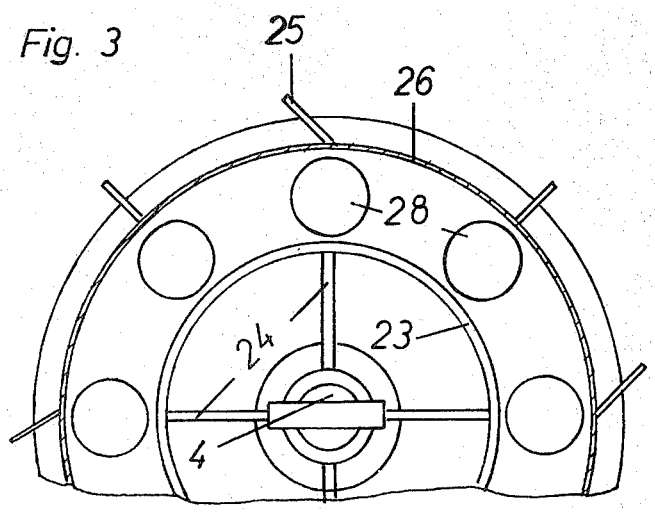

MIXING TUBE FOR DRYING BUILDING MATERIALS

The invention concerns a mixing tube for drying building materials such as sand, cement, limestone, gypsum, which in any event are also mixed completely with chemical additives, and will be used for the preparation of mortar, plaster, floor finish, insulating plaster, or the like, for the mixing with water and with air in a continuously flowing process, whereby at the upper end of the mixing tube the feed for the dry material is arranged, in the vertical or inclined axial line of the mixing tube a rotating shaft is arranged with stirring blades, and at the lower end a conveying pump is connected.

The task which the invention is based on is then directed towards the design of such a mixing tube, that in the continuously extractable finished mixture there is a high process occurring, and not, perchance, by the chemical constituents.

According to this invention this problem is solved in such a way that with a mixing tube of the preceding described kind, the stirring blades are supported on plates or discs tightly connected all around to the rotating shaft, or to a casing rotating with it, which—with respect to the rotational axis line—are conically inclined from the inside above to the outside downward, and maintain a fixed distance from the inner wall of the mixing tube, and that on the mixing tube inner wall, in intermediate stages, tightly fastened all around discs are connected as intermediate chamber bottoms, which—with respect to the rotational axis line—are inclined from the rotating shaft or the casing rotating with it.

With the invention there is in the mixing tube a majority of at least two chambers in stages arranged under each other into which, at any time, a rotating plate projects and produces a partition at any time into space parts which communicate with one another through a relatively small annular gap. The chambers themselves communicate with one another through a relatively small annular gap next to the rotating shaft. In that way, the path of the mixed material during its passage through the mixing tube runs on a zig-zag course from inside outward and again from outside inward. On this path, narrow passages alternate with expansions, which has a considerable influence on the air transported with it.

The mixed material is put into motion by the blades. Expediently, these are, like paddles, so set in relation to the rotational axis line that those situated on the upper side of the plate convey toward the outside, and those situated on the lower side of the plate convey toward the inside.

Blades which are supported by plates tightly connected all around to the rotating shaft, which maintain a fixed distance from the inner wall of the mixing tube, as well as plates tightly connected all around to the mixing tube inner wall as intermediate chamber walls sloped from outside to inside, which maintain a fixed distance from the rotating shaft, are known from DE patent Publication No. 463 559. The mixing machine shown there, especially for mortar and the like, possesses however, no air entrance at all. The individual materials to be mixed run through individual feeding hoppers from containers, uninterrupted, and are metered by means of screw conveyors. The separator plates are sloped from outside about to inside below—with respect to the rotational axis line—and thus lie parallel to the intermediate chamber bottoms. The intermediate bottoms form a double pairing, between which is situated a stagnant empty space. Below the upper mixing chamber in which only dry substances are mixed, water is added to the lower mixing chamber. The problem which the invention is based on can not be solved by this, and the manner of operation according to the invention can not be achieved. The finished mixture, free of air pores, is discharged below through an outlet to the outside.

Advantageous particulars of the invention are the subject of the claims below, and in the description of the performance example by means of the drawings, are also explained in detail.

The mixing tube can be put into action in a vertical standing, or in a more or less strongly deviating inclined position. Since the rotating shaft rotates at about 350 to 400 rpm, such a high speed of rotation of the paddles make the effectiveness of the mixing effect substantially independent of the maintenance of a vertical placement of its rotational axis line. With a very severely inclined position according to an example explained in detail in the drawings, there results only the necessity to make certain changes in the feeding of the dry material and of the water, and at the discharge place.

The core of the invention, however, remains preserved.

BRIEF DESCRIPTION OF DRAWINGS

Two performance examples of the invention are schematically presented in the drawings. They show:

FIG. 2 Only the rotor belonging to it.

FIG. 3 A top view of FIG. 2 in the plane AA.

DESCRIPTION OF PREFERRED EMBODIMENTS

Figure 1:
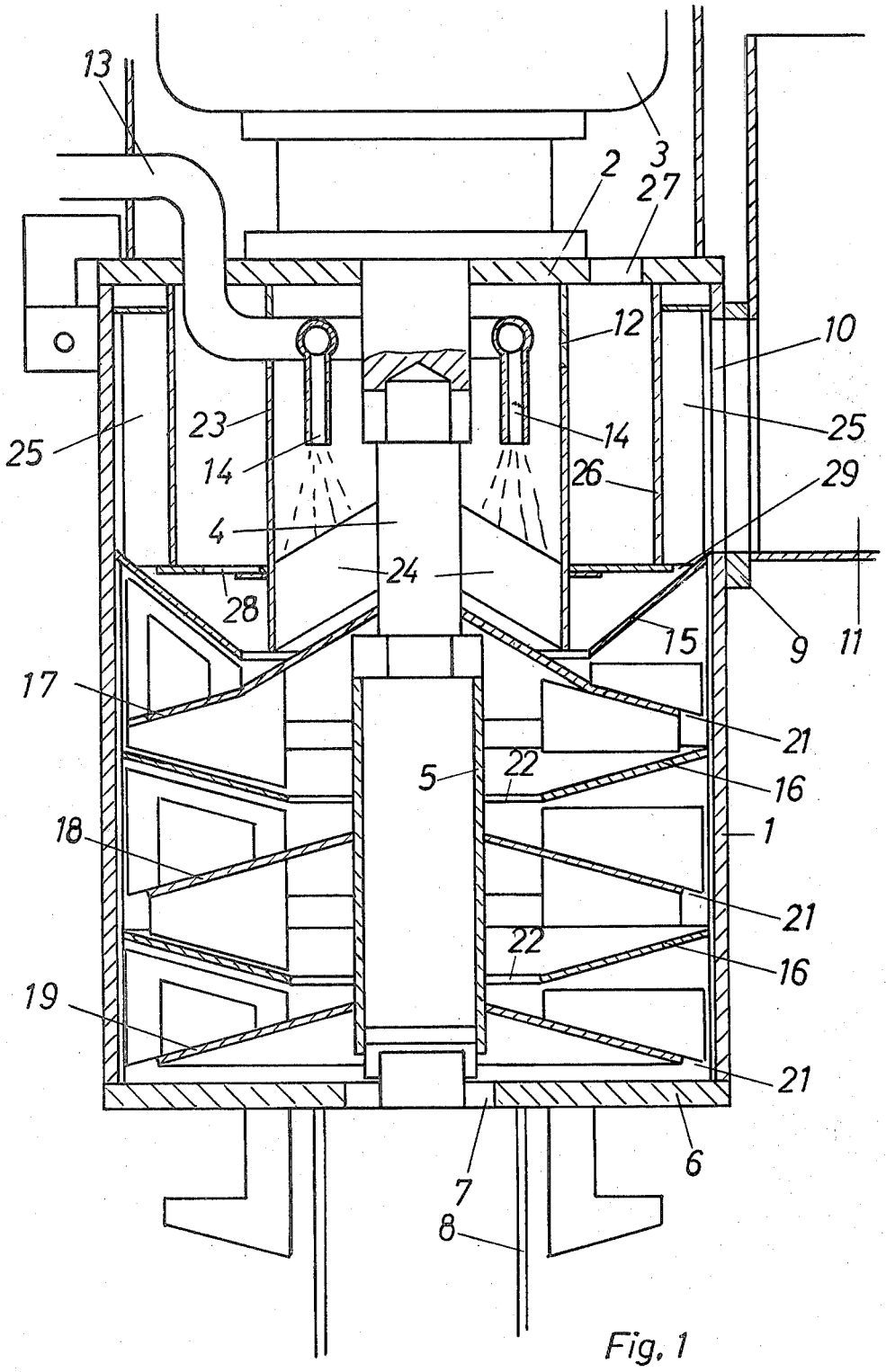
FIG. 1 A rotationally symmetrical section lengthwise of a vertical standing mixing tube in front elevation.

According to FIG. 1, the mixing tube (1) has a cover (2) which supports the electric motor (3) for the rotary drive of the shaft (4) or the thereon fastened casing (5), as well as a horizontal bottom (6) with a central opening (7) for connection to the suction side of an eccentric screw conveyor pump (8). The mixing tube (1) has a connection (10), closable by a slide valve (9), to a hand-, sack-, storage bin- or premixer-feed (11), as well as a water supply (13) to the spray nozzels (14), at least two of which are provided, mounted in a stationary cylindrical part (12). Stationary in the mixing tube (1), and firmly fastened to its inner wall, are a feeding hopper (15) and two mixing chamber bottoms (16), which as discs, are inclined downward toward the inside, conically.

The rotating shaft (4), or the casing (5) rotating with it, supports (3) plates or discs (17), (18), and (19) which are tightly connected all around, and are conically inclined from above inside downward to the outside (see FIG. 2). These support on their upper and lower sides—with (19) only on the upper side—paddles (20). These can have different shapes. As an example, two different shapes are specified at any given time, for the right and left. They are expediently bent from an absolutely radial plane, and transposed with respect to the rotational axis line in order to obtain a conveying effect, namely in the outward direction on the upper side and in the inward direction of the lower side. The plates (17), (18), and (19) maintain a distance to the inner wall of the mixing tube 1, so that a narrow annular gap (21) exists. The mixing chamber bottoms (16) maintain a distance to the casing (5), so that an annular gap (22) exists there. The mixing material thus passes through the length of the mixing tube (1) on a zig-zag course, from upper inside to outside below, and again to inside below and again to outside below, etc. according to the number of mixing chambers which are between the bottoms (16).

As a continuation of the already mentioned stationary cylindrical part (12), lies a cylinder (23) which rotates with the rotating shaft (4) by means of some rib bars (24). It ends below the upper part of the uppermost plate (17) in the plane of the orifice openings of a feeding hopper (15), as shown in FIG. 1.

The water sprayed out by the spray nozzles (14) strikes on the upper side of plate (17) resulting, from its conical inclination and rotation, in a very uniform distribution of the dry material that arrived at the orifices of the hopper (15), that was picked up at the connection (10) by the scrapers (25) of a cylinder (26) rotating with the rotating shaft (4) and has been distributed above the annular gap (29). In the annular space between the cylinder (26) and the cylinder parts (12) and (23), through holes (27) and (28), air from outside can enter from above. Thus with the entrance into the cascade mechanism of the mixing tube, the dry material, water and air are already mixed with each other. This mixing effect is repeated within each mixing chamber and is reinforced by the paddles (20) and the rerouting at the annular gaps (21) and (22). With this, an expansion of the space follows each construction in the transport path. Already in the first chamber, air can collect below the hopper wall (15) as a cushion with pressure reservoir action, which helps with the further transport. On the other hand, at the connection (7) to the suction side of the pump (8), there is a relatively longer path from the annular gap (21) below the plate (19), so that no harmful effect is to be feared from the suction action of pump (8).

Figure 4:
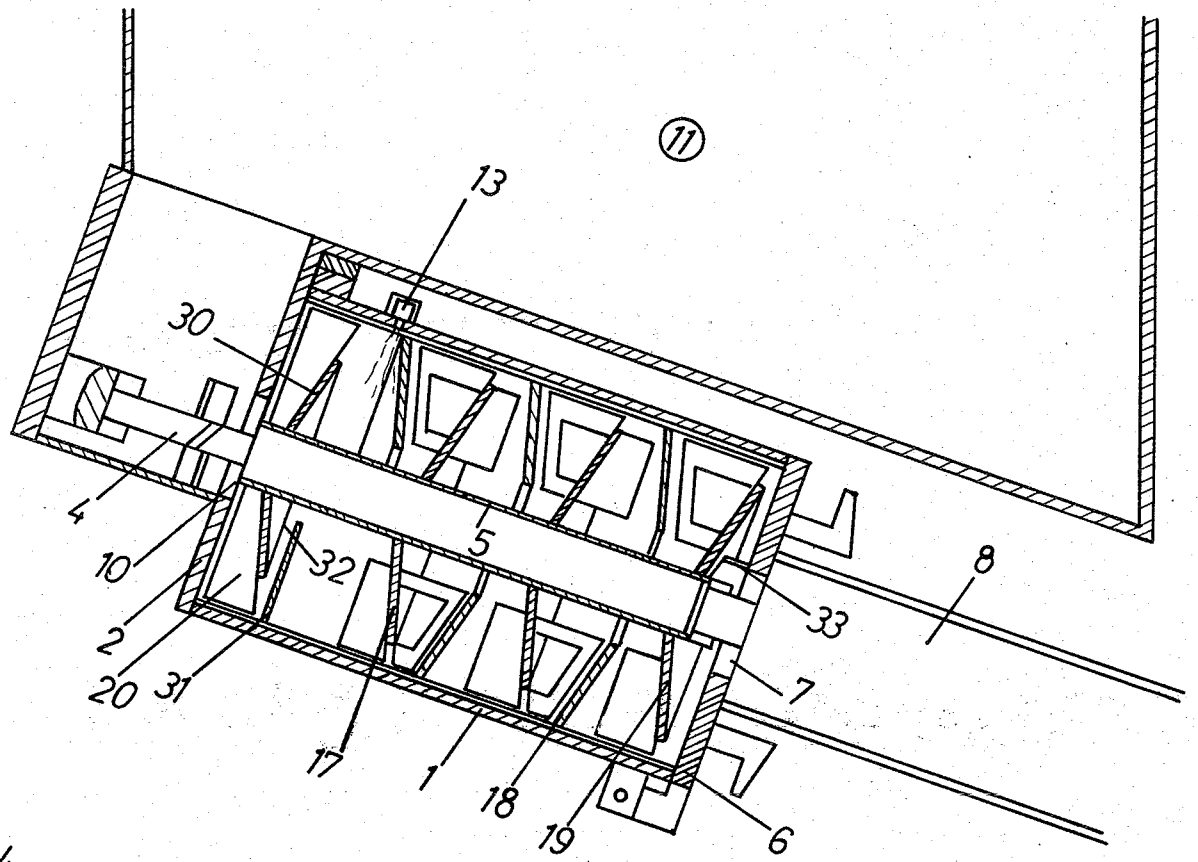
FIG. 4 An inclined mixing tube in the lengthwise section.

FIG. 4 shows a mixing tube in a severely inclined position of its rotational axis line. With respect to this rotational axis line, the construction of the mixing chambers with their chamber bottoms and with the paddle supports projected into them, is the same as described by means of FIGS. 1-3. Therefore, in FIG. 4, the same reference numerals are also used for the same or equivalent parts.

The inclined position requires only a change of the feed for the dry material, in that it—with respect to the rotational axis line—takes place on top at (10), above an uppermost, rotating together with the rotating shaft (4), downward inclined conical plate (30), on whose upper side a paddle (20) is situated, and sinks into a trough (32), separated by a half bottom plate shield (31), water spray nozzles are distributed on the opposite annular passages of the mixing tube (1), which are fed with water by a semicircular duct (13). The central opening (7) for connection of the conveying pump (8) is in the upper half—with respect to the water level—surrounded by an annular collar (33).

In the cool time of the year it can be advantageous if warmed air can be fed to the air entrance (27) in FIG. 1 from the electric motor arranged above it.

I claim:

1. An apparatus for mixing dry building materials with water and air in a continuously flowing manner comprising:

a mixing tube having upper and lower portions;

a rotating shaft within said tube extending from said upper portion to said lower portion;

feed means for said dry material, arranged in said upper portion and conveying pump means situated at the said lower end portion;

supporting plates surrounding and joined to said rotating shaft in a conically sloped manner so that with respect to the rotational axis line of the shaft the supporting plates are sloped from the inside above to outside downward and maintain a fixed distance to an inner wall of the mixing tube;

stirring blades supported on said plates; and fixed plates joined completely around the inner wall of the mixing tube which are sloped with respect to the rotational axis line of the shaft from outside above to inside downward and maintain a fixed distance from the rotating shaft.

2. The apparatus of claim 1 wherein there are three of said fixed plates between each pair of which one of said supporting plates projects.

3. The apparatus according to claim 2 wherein the conveying pump means is connected to the tube with its suction side on a central opening of a mixing tube bottom lying perpendicular to the rotational axis line of the shaft immediately above which a supporting plate supporting one of said stirring blades only at its upper side is positioned.

4. The apparatus according to claim 1, 2, or 3, wherein stirring blades are supported on the upper and lower sides of said supporting plates such that stirring blades on the upper side of the supporting plates have appropriate inclination with respect to the rotational axis line to convey material outward, while stirring blades on the lower side of the supporting plates have appropriate inclination with respect to the rotational axis line of the shaft to convey material inward.

5. The apparatus according to claim 4 with a substantially vertical rotational axis line wherein water and dry material is fed onto the upper side of the uppermost supporting plate above approximately the middle of the supporting plate by feeding means for the dry material, said means separated from water supply means by a wall rotating with said shaft.

6. The apparatus according to claim 5 wherein the feeding means for the dry material is a hopper which has an orifice and is attached to the inner side of a wall defining the mixing tube, the rotating wall comprises a first cylinder connected to the said shaft by ribs and having a lower edge, said edge ending at the said orifice, and wherein said water supply means are spray nozzles arranged within the said first cylinder.

7. The apparatus according to claim 6 wherein attached outward from said first cylinder is a rotating scraper which contacts on its outer side the dry material and wherein air enters the apparatus between said scraper and said rotating first cylinder.

8. The apparatus according to claim 7 wherein the air entering the apparatus is first warmed by an electric motor used for rotating the shaft.

9. The apparatus according to claim 7 wherein the rotating scraper comprises a second cylinder having a greater diameter than the first cylinder, is rotating therewith and has at its outside scraper blades attached thereto.

10. The apparatus according to claim 9 wherein the air entering the apparatus is first warmed by an electric motor used for rotating the shaft.

11. The apparatus according to claim 1, 2 or 3 with an inclined rotational axis line wherein dry material is fed onto the top of the uppermost supporting plate which has mixing blades on its upper side and from which the dry material moves into a trough separated from the lower portion of the mixing tube by a shield, said blades moving through said trough, and wherein water is fed into the mixing tube on the other side thereof being opposite the shield.

12. The apparatus according to claim 11 wherein the water is fed by a semi-circular duct.

13. The apparatus of claim 12 wherein the shield extends substantially halfway around the mixing tube downward from the shaft.

14. The apparatus according to claim 11, wherein the central opening for connection of the conveying pump is in its upper half circle surrounded by a semi-annular collar.

* * * * *